United States Patent [19]

Shigeta et al.

[11] Patent Number: 4,637,973

[45] Date of Patent: Jan. 20, 1987

[54] IMAGE FORMING PROCESS FOR ELECTROPHOTOGRAPHY

[75] Inventors: Kunio Shigeta; Yoko Yamamoto; Jiro Takahashi, all of Hachioji, Japan

[73] Assignee: Konishiroku Photo Industry Co., Ltd., Tokyo, Japan

[21] Appl. No.: 795,652

[22] Filed: Nov. 6, 1985

[30] Foreign Application Priority Data

| | | | |
|---|---|---|---|
| Nov. 15, 1984 | [JP] | Japan | 59-239540 |
| Nov. 16, 1984 | [JP] | Japan | 59-240542 |
| Nov. 26, 1984 | [JP] | Japan | 59-247971 |

[51] Int. Cl.[4] ..... G03G 9/14

[52] U.S. Cl. ..... 430/122; 118/657; 430/110; 430/106.6

[58] Field of Search ..... 430/122, 123, 120, 110; 118/657

[56] References Cited

U.S. PATENT DOCUMENTS

| | | | |
|---|---|---|---|
| 3,873,355 | 3/1975 | Queener et al. | 430/108 |
| 4,098,228 | 7/1978 | Ruckdeschel et al. | 430/122 X |
| 4,309,498 | 1/1982 | Yamashita et al. | 430/122 X |
| 4,447,517 | 5/1984 | Yuge et al. | 430/122 |

*Primary Examiner*—John D. Welsh

*Attorney, Agent, or Firm*—Frishauf, Holtz, Goodman & Woodward

[57] ABSTRACT

In a process for forming an image comprising;

(i) forming a latent image on a latent image bearing member comprising an organic photoconductive photosensitive member;

(ii) forming a magnetic brush with a two-component developer comprising a toner and a carrier on a developer carrying member arranged as opposed to said latent image bearing member; and (iii) developing said latent image by brushing it with said magnetic brush in developing region;

the improvement wherein said latent image bearing member and said developer carrying member move in the same direction in the developing region, and the ratio $V_S/V_P$ of the linear velocity of said developer carrying member $V_S$ to the linear velocity of said latent image bearing member $V_P$ is within the range of $1.9 \leqq V_S/V_P \leqq 4$.

According to this process, an image which is free from fog, yet high in image density and stable for repeated copying can be obtained.

20 Claims, 7 Drawing Figures

IMAGE FORMING PROCESS FOR ELECTROPHOTOGRAPHY

BACKGROUND OF THE INVENTION

This invention relates to an image forming process including the step of developing electrostatic latent images formed in electrophotography, electrostatic recording, electrostatic printing, etc. by use of an organic photoconductive photosensitive member, with a two-component developer.

At present, for formation of a visible image from a certain image information, a method via electrostatic latent images such as electrophotography, etc has been widely used. For example, according to an example of electrophotography, electrostatic latent images formed on a latent image bearing member comprising a photoconductive photosensitive member by the charging step and the exposure step is developed with a developer comprising electroscopic colored particles called toner, and the resulting toner image is ordinarily transferred onto a transfer material and fixed to give a visible image.

The developers to be used in development of such electrostatic latent images may be classified into the so called two-component developer comprising a mixture of toner and carrier and the so called one-component developer comprising a magnetic toner containing magnetic material which is to be used solely without being mixed with carrier. In the system employing the two-component developer, toner is subjected to triboelectric charging by stirring mechanically toner with carrier, whereby it is possible to control to a considerable extent the polarity of charging and the amount of charging of the toner by choosing the characteristics of the carrier, the conditions of stirring, etc. In this respect, the two-component developer is superior to the one-component developer.

The developing method includes the magnetic brush method, the cascade method, etc., of which the magnetic brush has preferably been employed. The magnetic brush method is a method, in which pikes of developer erected in a brush-like shape by magnetic force on a developer conveying support, namely, magnetic brush, is formed and the magnetic brush is brushed against the surface of a latent image bearing member, thereby attaching toner particles onto electrostatic latent images to effect development.

In the developing method utilizing such a magnetic brush method, etc., the toner particles may also be attached on the background portion other than the electrostatic image portions on which they are to be attached, thereby staining the image and causing the problem of generation of the so called "fog". Such generation of fog is caused primarily by the toner which contains partially toner particles inadequately charged and will frequently occur in the case of, for example, containing weakly charged toner not reaching the amount of charging essentially required for toner, or oppositely charged toner having the polarity opposite to that essentially required for toner. For prevention of such generation of fog, a number of charge controlling techniques have been proposed in the prior art. Further, for example, application of an appropriate bias voltage between the developer conveying support and the latent image bearing member upon development has been used as an effective means.

However, when an organic photoconductive photosensitive member (herein after called "OPC photosensitive member") is used as the photoconductive member constituting the latent image bearing member, it has been found that there is generation of fog which cannot be removed even by application of a bias voltage. The cause for generation of such a fog is not necessarily clear, but it may be considered that the toner will be charged through friction with the OPC photosensitive member when the magnetic brushes the latent image bearing member and the toner will be attached on the background portion other than the latent image portion on the OPC photosensitive member, and the attached toner will be consequently transferred and fixed onto a transfer material whereby fog as mentioned above will be formed.

Also, toner in a developer in a developing processor is consumed every time with development and fresh toner is supplemented corresponding thereto. Thus, toner is constantly renewed in a developing processor. Whereas, as for carrier, the originally prepared carrier is used repeatedly over a long term. For this reason, after repeated development, characteristics of the carrier will be deteriorated and the triboelectric charging characteristic of the carrier becomes unstable to result in generation of fog through the increase of weakly charged toner or oppositely charged toner, whereby it is not consequently possible to obtain stably good images for a large number of times.

The present inventors have made intensive studies on the basis of such viewpoints and, as a result, found that generation of fog as described above depends seriously on magnitude of the impact force which an OPC photosensitive member receives from a magnetic brush when the magnetic brush brushes the OPC photosensitive member, and accomplished this invention on the basis of such a finding.

SUMMARY OF THE INVENTION

This invention has been accomplished under the state of the art as described above and its object is to provide an image forming method capable of forming an image which is free from fog and yet high in image density stably for a number of times.

The above object can be accomplished by, in a process for forming an image comprising;

(i) forming a latent image on a latent image bearing member comprising an organic photoconductive photosensitive member;

(ii) forming a magnetic brush with a two-component developer comprising a toner and a carrier on a developer carrying member arranged as opposed to said latent image bearing member; and (iii) developing said latent image by brushing it with said magnetic brush in developing region;

the improvement wherein said latent image bearing member and said developer carrying member move in the same direction in the developing region, and the ratio $V_S/V_P$ of the linear velocity of said developer carrying member $V_S$ to the linear velocity of said latent image bearing member $V_P$ is within the range of $1.9 \leqq V_S/V_P \leqq 4$.

In one of embodiments of this invention, the above carrier is a resin-coated type one in which a specific polymer described hereinafter is used as the resin.

DESCRIPTION OF PREFERRED EMBODIMENTS

Figure 1:
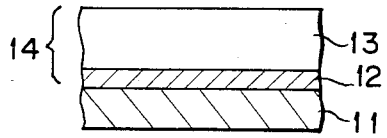
FIGS. 1 through 6 are sectional views of mechanical constitutional examples of organic photoconductive photosensitive members, respectively.

Referring now to an example in which this invention is applied for electrophotography, this invention is described in detail.

In this invention, a developer carrying member is arranged as opposed to a latent image bearing member comprising an organic photoconductive photosensitive member through an intermediary gap, namely a developing region, moving the electrostatic latent image formed on the latent image bearing member to the developing region while moving the latent image bearing member under the condition such that the ratio $V_S/V_P$ of the linear velocity of said developer carrying member $V_S$ to that of said latent image bearing member $V_P$ is within the range of $1.9 \leqq V_S/V_P \leqq 4$, and said developer carrying member and said latent image bearing member move in the same direction in the developing region, simultaneouly with spikes erected in a brush formed of a two-component developer comprising toner and carrier, namely a magnetic brush, into the developing region, and brushing the electrostatic latent image on the latent image bearing member in the developing region with the magnetic brush to thereby effect development and form a toner image through attachment electrostatically of the toner particles in the magnetic brush onto the electrostatic latent image. Subsequently, the toner image is transferred onto a transfer material such as paper by, for example, electrostatic transfer and the transferred image is subjected to fixing processing accorting to, for example, the contact heating fixing system with heated rollers in a fixer to thereby form a visible image.

In the above description, the linear velocity of the developer carrying member $V_S$ refers to the moving velocity in the conveying direction when the magnetic brush is conveyed into the developing region (the velocity in the tangential direction in which the cylinder rotates in the case of a cylindrical developer carrying member such as a developing sleeve), and the linear velocity of the latent image bearing member $V_P$ refers to the moving velocity in the moving direction when the plane of the latent image bearing member moves through the developing region.

In this invention, image is formed in the manner as described above, and the primary specific features reside in the following points:

(a) the ratio $V_S/V_P$ of the linear velocity of said developer carrying member $V_S$ to that of said latent image bearing member $V_P$ is within the range of 1.9 to 4; and (b) the developer carrying member and said latent image bearing member move in the same direction in the developing region. By satisfying such conditions (a) and (b), generation of fog can be prevented and yet it becomes possible to form an image of sufficiently high image density. More specifically, by satisfying the condition (b), the impact force which the OPC photosensitive member receives by brushing of a magnetic brush is alleviated considerably, and by satisfying the condition (a), the magnitude of the above impact force and the toner quantity conveyed into the developing region can be made within the appropriate ranges. As the result, while the above impact force is great when the value of $V_S/V_P$ is large to readily generate fog through toner attachment on the background portion caused by triboelectric charges by friction between the magnetic brush and the OPC photosensitive member, such a generation of fog can be prevented. Besides, while image density may be lowered due to shortage of the toner quantity conveyed into the developing region when the value of $V_S/V_P$ is small, such lowering in image density can be prevented.

This invention is to be described in more detail below.

The developer carrying member for feeding a two-component developer to a developing region may preferably be, for example, a developing sleeve. Developing sleeve may consist of a plurality of sleeves or one sleeve, but more preferable image formation can be effected in a developing sleeve consisting of one sleeve. The developer carrying member may have a structure on which a bias voltage can be applied, and for example, may be constituted of a cylindrical sleeve for supporting a magnetic brush on its surface and a magnet having plurality of poles arranged internally of the sleeve, whereby the magnetic brush on the sleeve can be conveyed by rotation of the sleeve into the developing region.

The magnetic brush supported on a developer carrying member should be preferably conveyed into the developing region under the state of uniform height in order to effect uniform development without irregularity. For this purpose, it is preferable to provide a doctor blade in the upper stream of the developing region of the developer carrying member for regulating the height of the magnetic brush to thereby cut the height of the brush to a constant level. The doctor blade may be made of either a magnetic material or a non-magnetic material. The distance between the edge of the doctor blade and the surface of the developer carrying member (Hcut) is set depending on the size of the gap between the latent image bearing member and the developer conveying support (Dsd) in the developing region. In order that the tip of the magnetic brush may contact moderately the surface to be developed of the latent image bearing member and yet the toner may be supplied to the developing region in an amount enough to give high image density, the distance (Hcut) should be preferably made about 0.8-fold of the gap (Dsd). The gap (Dsd) may preferably be, for example, 0.3 to 4.0 mm. In the case of the gap (Dsd) less than 0.3 mm, uniform developing action can be obtained with difficulty in the developing region, and also image density is liable to be lowered due to shortage of toner quantity contributing development. On the other hand, if the gap (Dsd) exceeds 4.0 mm, the counter-electrode effect in the developing region between the toner particles and the latent image will be lowered to lower readily image density, and also the edge effect of increased toner attachment on the outline portion relative to the center portion of latent image will appear greatly.

A bias voltage may be appllied on the developing region, if desired. The bias voltage is generally only direct current voltage, but it may alternatively a direct current voltage on which an alternating current voltage is overlapped. In the latter case, in addition to the effect of preventing attachment of toner particles on the background portion other than the latent image portion by the direct current voltage, the toner particles become readily scattered from the carrier particles by the alternating current to improve toner attachability onto the latent image. Although the voltage may have its absolute value of 0, it is generally about 300 (V) or lower, preferably 100 to 200 (V). The effective value of the alternating current voltage may be, for example, about 100 V to 5 KV, its frequency being preferably, for example, about 100 Hz to 10 KHz.

The latent image bearing member to be used in the present invention comprises an organic photoconductive photosensitive member (OPC photosensitive member). The OPC photosensitive member is constituted by forming a photosensitive layer comprising a photoconductive substance of an organic compound, either alone or optionally dispersed in a binder resin, on an electroconductive substrate. Such a photosensitive layer should preferably be made of a two-layer structure having a carrier generation layer comprising a carrier generation substance which generates charged carriers by absorption of visible light, combined with a carrier transport layer containing a carrier transport substance which transports either one or both of the positive or negative carriers generated in the carrier generation layer. Thus, by permitting separate layers to bear the two basic functions necessary in the photosensitive layer, namely generation of carrier and its transport, respectively, the scope of choice of materials useful for constitution of the photosensitive layer can be broadened and it becomes possible to select independently the substances or the substance systems which can optimally fulfill the respective functions. Also, by doing so, a photosensitive member having various characteristics demanded in electrophotographic process, in other words, excellent characteristics, for example, high surface potential when charged, great charge retentivity, high photosensitivity, great stability in repeated uses, etc. can be constituted.

Such carrier generating substances may include, for example, anthanthrone type pigment, perylene derivatives, phthalocyanine type pigments, azo type dyes, indigoid type dyes, etc., and the carrier transport substances may include, for example, carbazole derivatives, oxadiazole derivatives, triarylamine derivatives, polyarylalkane derivatives, hydrazone derivatives, pyrazoline derivatives, stilbene derivatives, styryltriarylamine derivatives, etc.

The binder resin constituting the photosensitive layer in the OPC photosensitive member may be insulating resins, including, for example, addition polymerization type resins, polyaddition type resins and polycondensation type resins such as polyethylene, polypropylene, acrylic resins, methacryilc resins, vinyl chloride resins, vinyl acetate resins, epoxy resins, polyurethane resins, phenol resins, polyester resins, alkyd resins, polycarbonate resins, silicone resins, melamine resins, etc. as well as copolymer resins containing two or more of the recurring units in these resins, such as vinyl chloride-vinyl acetate copolymer resins, vinyl chloride-vinyl acetate-maleic anhydride copolymer resins, styrene-acrylic copolymer resins, etc., or otherwise polymeric organic semiconductors such as poly-N-vinylcarbazole, etc.

The material constituting the electroconductive substrate in the OPC photosensitive member may be, for example, a metal sheet such as of aluminum, nickel, copper, zinc, palladium, silver, indium, tin, platinum, gold, stainless steel, brass, etc.

Such OPC photosensitive members may take various mechanical constitutions, which are not particularly limited in the present invention, and any constitution may be available. It is particularly preferable to use an OPC photosensitive member exhibiting an absolute value of the surface potential of, for example, 400 to 700 (V) when charged.

Figure 2:
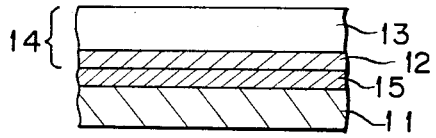
Figure 3:
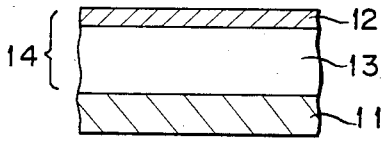
Figure 4:
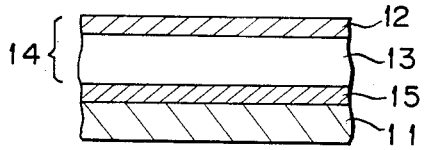
Figure 5:
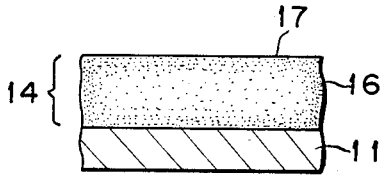
Figure 6:
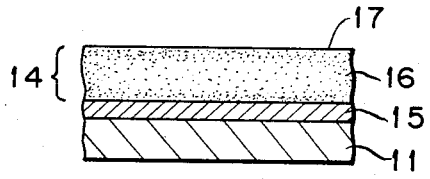

FIGS. 1 through 6 each show a mechanical constitutional example of OPC photosensitive member, and each of FIG. 1 and FIG. 3 is an example in which a photosensitive layer 14 comprising laminates of a carrier generation layer 12 composed mainly of a carrier generation substance and a carrier transport layer 13 containing a carrier transport substance as the main component is provided on an electroconductive substrate 11. Each of FIG. 2 and FIG. 4 is an example in which an intermediate layer 15 is provided between the photosensitive layer 14 and the electroconductive substrate 11. FIG. 5 and FIG. 6 are examples in which a photosensitive layer 14 having a carrier generating substance 17 dispersed in a layer 16 composed mainly of a carrier transport substance is provided on the electroconductive substrate 11 directly and through an intermediate layer 15, respectively. The toner constituting the two-component developer to be used in the present invention comprises toner components such as a colorant dispersed in a binder resin, and here may be used various thermoplastic resins as the binder resin. Typical examples may include, for example, polymers of monomers selected from styrenes such as styrene, p-chlorostyrene, $\alpha$-methylstyrene and the like; $\alpha$-methylene aliphatic monocarboxylic acid esters such as methyl acrylate, ethyl acrylate, n-propyl acrylate, lauryl acrylate, 2-ethylhexyl acrylate, methyl methacrylate, ethyl methacrylate, n-butyl methacrylate, lauryl methacrylate, 2-ethylhexyl methacrylate and the like; vinyl nitriles such as acrylonitrile, methacrylonitrile and the like; vinylpyridines such as 2-vinylpyridine, 4-vinylpyridine and the like; vinyl ethers such as vinyl methyl ether, vinyl isobutyl ether and the like; vinyl ketones such as vinyl methyl ketone, vinyl ethyl ketone, methyl isopropenyl ketone and the like; unsaturated hydrocarbons such as ethylene, propylene, isoprene, butadiene and the like and halogenated products thereof, halogen type unsaturated hydrocarbons such as chloroprene, etc., or copolymers obtained by combination of two or more of these monomers, and mixtures of these, or non-vinyl condensation type resins such as rosin-modified phenol-formalin resins, epoxy resins, polyester resins, polyurethene resins, polyamide resins, cellulose resins, polyether resins, etc., or mixtures of these resins with the above-mentioned vinyl type resins. The colorant may be, for example, carbon black, Nigrosine dyes, Aniline Blue, Chalcooil Blue, Chrome Yellow, Ultramarine Blue, Methylene Blue, Rose Bengal, Phthalocyanine Blue or a mixture of these. Other toner components than colorant may include charge controllers, off-set preventives, free flowability improvers, etc., and magnetic fine powder may also be contained, if desired.

Such a toner can be obtained according to the method for preparation of toner known in the art, and a toner with a mean particle size of 20 $\mu$m or less, particularly from 8 to 12 $\mu$m, is preferred.

The carrier constituting the two-component developer may be either electroconductive or insulating, is not particularly limited in its constitution, and may be constituted of, for example, core particles comprising magnetic material coated on their surfaces with a resin, or magnetic fine powder dispersed and contained in a binder resin, and others.

The resin for coating or binder which can be used in preparation of a resin-coated type carrier or a magnetic material-dispersed type carrier may include homopolymers of monomers selected from styrenes such as styrene, p-chlorostyrene, methylstyrene and the like; vinyl halides such as vinyl chloride, vinyl bromide, vinyl fluoride and the like; vinyl esters such as vinyl acetate, vinyl propionate, vinyl benzoate, vinyl butyrate, etc.; α-methylene aliphatic carboxylic acid esters such as methyl acrylate, ethyl acrylate, n-butyl acrylate, isobutyl acrylate, dodecyl acrylate, n-octyl acrylate, 3-chloroethyl acrylate, phenyl acrylate, methyl α-chloroacrylate, methyl methacrylate, ethyl methacrylate, butyl methacrylate, etc.; vinyl nitriles such as acrylonitrile, methacrylonitrile and the like; vinyl ethers such as vinyl methyl ether, vinyl isobutyl ether, vinyl ethyl ether and the like; vinyl ketones such as vinyl methyl ketone, vinyl hexyl ketone, methyl isopropenyl ketone and the like; and so on, or other resins such as epoxy resins, rosin-modified phenol formalin resins, cellulose resins, polyether resins, polyvinylbutyral resins, polyester resins, styrenebutadiene resins, polyvinylformal resins, polycarbonate resins, fluorine resins, etc., which can be used either alone or as a blend.

Among them, such resins as fluorine resins, vinyl chloride-vinyl acetate resins or polyester resins may preferably be used, particularly preferably fluorine resins such as polyvinylidene fluoride, polytetrafluoroethylene, polyfluoro(meth)acrylate and the like.

In an embodiment in which a resin coated carrier is used as the carrier constituting the two-component developer to be used in the present invention, the resin for coating may particularly preferably powdery particles comprising a core material and, provided on the surface of the core material, a coated layer of a composition containing a polymer of a monomeric composition containing preferably 50 wt. % or more of the monomers represented by Formulae (I) or (II) below (hereinafter sometimes also called "specific polymer") or said polymer together with other substances optionally added.

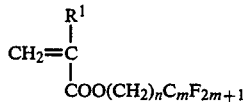
Formula (I)

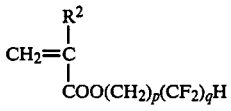
Formula (II)

wherein $R^1$ and $R^2$ each represent a hydrogen atom or a methyl group, each of n and p represents an integer of 1 to 8, each of m and q represents an integer of 1 to 19.

Among the monomers represented by the above Formulae (I) and (II), from the viewpoint of triboelectric charging characteristics, monomers represented by the following Formulae (I') or (II') are particularly preferable.

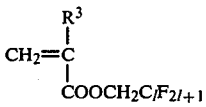
Formula (I')

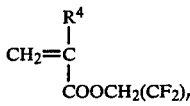
Formula (II')

wherein $R^3$ and $R^4$ each represent a hydrogen atom or a methyl group, l represents an integer of 1 or 2 and r represents an integer of 2 to 4.

As a preferred monomer represented by the Formulae (I) and (II) described above include, for example, 1, 1-dihydroperfluoroethyl methacryolate, 1, 1, 3-trihydroperfluoro-n-propyl methacrylate and the like.

The polymer of the monomer represented by Formula (I) or (II) may include, for example, those having recurring units shown by the structural formulae show below, which are not limitative of the present invention:

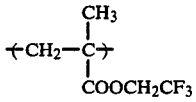
(1)

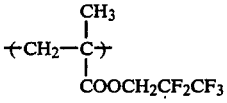
(2)

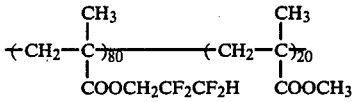
(3)

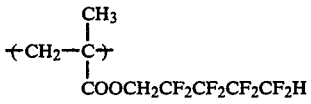
(4)

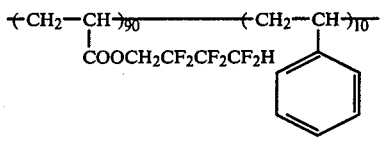
(5)

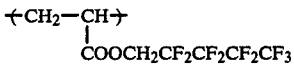
(6)

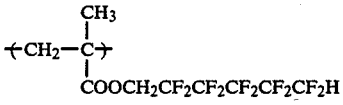
(7)

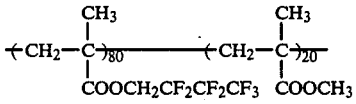
(8)

The above specific polymer can be obtained by polymerization of a monomeric composition containing preferably 50 wt. % or more of the monomer (I) or (II), and other monomers available may include, for example, styrenes such as styrene, p-chlorostyrene, α-methyl-styrene and the like; α-methylene alipharic monocarboxylic acid esters such as methyl acrylate, ethyl acrylate, n-propyl acrylate, lauryl acrylate, 2-ethylhexyl acrylate, methyl methacrylate, ethyl methacrylate, n-butyl methacrylate, lauryl methacrylate, 2-ethylhexyl methacrylate and the like; etc.

In another embodiment in which a resin coated carrier is used as the carrier constituting the two-component developer to be used in the present invention, the resin for coating may particularly preferably powdery particles comprising a core material and, provided on the surface of the core material, a coated layer of a composition containing a polymer of a monomeric composition containing preferably 50 wt. % or more of the monomers represented by Formula (III) below (hereinafter sometimes also called "specific polymer") or said polymer together with other substances optionally added.

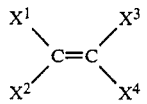

Formula (III)

wherein $X^1$, $X^2$, $X^3$ and $X^4$ each represent a hydrogen atom, a chlorine atom, a fluorine atom, a lower perfluoroalkyl group or a lower perfluoroalkoxy group, which may be either identical or different, and at least 2 of $X^1$, $X^2$, $X^3$ and $X^4$ are fluorine atoms.

The above monomer represented by Formula (III) may be exemplified by those represented by the following structural formulae:

$CF_2{=}CF_2$ "TFE" (tetrafluoroethylene); (1)

$CF_2{=}CF(CF_3)$ (hexafluoropropylene); (2)

$CF_2{=}CFCl$ "CTFE" (chlorotrifluoroethylene); (3)

$CH_2{=}CF_2$ "VdF" (vinylidene fluoride); (4)

$CF_2{=}CF(OC_3F_7)$ (perfluoropropylvinylether); (5)

The above specific polymer can be obtained by polymerization of a monomeric composition containing preferably 50 wt. % or more of the above monomer (III), and other monomers available may include, for example, ethylene, propylene, etc.

The substance which can be incorporated in the composition containing the above specific polymer may include, for example, polymers of monomers selected from styrenes such as styrene, p-chlorostyrene, α-methylstyrene and the like; α-methylene aliphatic monocarboxylic acid esters such as methyl acrylate, ethyl acrylate, n-propyl acrylate, lauryl acrylate, 2-ethylhexyl acrylate, methyl methacrylate, ethyl methacrylate, n-butyl methacrylate, lauryl methacrylate, 2-ethylhexyl methacrylate and the like; etc. or copolymers obtained by combination of two or more of these monomers, and mixtures thereof.

Examples of the above specific polymer are enumerated below:

Vinylidene fluoride-tetrafluoroethylene copolymer: $-(CH_2CF_2)-(CF_2CF_2)-$
(trade name)
"VT-100" (produced by Daikin Co.)
"VT-50" (produced by Daikin Co.)
"Kynar 7201" (Pennwalt Co.)

Polytetrafluoroethylene (PTFE): $-(CF_2CF_2)_n-$
(trade name)
"Algofron" (produced by Montecatini Edison Co.)
"Fluon" (produced by ICI Co.)
"Halon TFE" (produced by Allied Chemical Co.)
"Hostaflon" (produced by Hoechst Co.)
"Polyflon" (produced by Daikin Co.)
"Soreflon" (produced by Ugine Kuhlmann Co.)
"Teflon TFE" (produced by Du Pont Co.)
"Teflon J" (produced by Mitsui Fluorochemical Co.)

Polychlorotrifluoroethylene (PCTFE): $-(CF_2CFCl)_n-$
(trade name)
"Daiflon" (produced by Daikin Co.)
"Kel-F" (produced by 3 M Co.)
"Plaskon CTFE" (produced by Allied Chemical Co.)
"Voltalef" (produced by Ugine Kuhlmann Co.)

Polyvinylidene fluoride (PVdF): $-(CH_2CF_2)_n-$
(trade name)
"Dulite" (produced by Du Pont Co.)
"Dyflor" (produced by Dynamit Nobel Co.)
"Fraflon" (produced by Ugine Kuhlmann Co.)
"KF polymer" (produced by Kureha Chemicals Co.)
"Kynar" (produced by Pennwalt Chemicals Co.)
"Solef" (produced by Solvay Co.)

Tetrafluoroethylene-hexafluoropropylene copolymer (FEP):

$$-(CF_2CF_2)-(CF_2CF(CF_3))-$$

(trade name)
"Neoflon" (produced by Daikin Co.)
"Teflon FEP" (produced by Du Pont Co.)

Tetrafluoroethylene-perfluoroalkyl vinyl ether copolymer (PFA):

$$-(CF_2CF_2)-(CF_2CF(OC_3F_7))-$$

(trade name) "Teflon PFA" (produced by Du Pont)

Tetrafluoroethylene-ethylene copolymer (ETFE): $-(CH_2CH_2)-(CF_2CF_2)-$
(trade name)
(produced by Asahi Glass Co.)
"Tefzel" (produced by Du Pont Co.)

Chlorotrifluoroethylene-ethylene copolymer (ECTFE): $-(CH_2CH_2)-(CF_2CFCl)-$
(trade name)
"Halar" (produced by Allied Chemical Co.)

Vinylidene fluoride-hexafluoropropylene copolymer:

$$-(CH_2CF_2)-(CF_2CF(CF_3))-$$

(trade name)
"Daiel" (produced by Daikin Co.)
"Viton" (produced by Du Pont Co.)
"Fluorel" (produced by 3 M Co.)
"Technoflon N.FOR" (produced by Montedison Co.)

Vinylidene fluoride-chlorotrifluoroethylene copolymer: $-(CH_2CF_2)-(CF_2CFCl)-$ (trade name)

"KelF Elastomer" (produced by 3 M Co.)

Vinylidene fluoride-pentafluoropropylene copolymer:

(trade name) "Technoflon T.S" (produced by Montedison Co.)

Tetrafluoroethylene-perfluoronitromethane copolymer:

(trade name) "Nitroso Rubbuer" (Thiokol Chemical Co.)

Tetrafluoroethylene-perfluoromethyl vinyl ether copolymer:

$$-(CF_2CF_2)-(CF_2\underset{\underset{OCF_3}{|}}{C}F)-$$

(trade name) "Kalrez" (produced by Du Pont)

Tetrafluoroethylene-propylene copolymer:

$$-(CF_2CF_2)-(CH_2\underset{\underset{CH_3}{|}}{C}H)-$$

(trade name) "Aflas" (produced by Asahi Glass Co.).

The above magnetic material constituting the carrier may include metals or alloys of metals exhibiting ferromagnetic property such as iron, cobalt, nickel, etc. or compounds containing these elements, typically ferrite or magnetite, or alloys which contains no ferromagnetic element, but exhibits by application of appropriate heat treatment, for example, various alloyl called Whisler alloys containing manganese and copper such as manganese-copper-aluminum, manganese-copper-tin, etc., or chromium dioxide, and others.

The carrier to be used in the present invention may also contain additives such as charge controllers, fluidity improvers, etc.

When the carrier is to be made of a resin coated carrier, it can be prepared, for example, as follows. That is, the resin for coating as described above is dissolved in a solvent such as ketones (e.g. acetone, methyl ethyl ketone, etc.), tetrahydrofuran, dioxane, dimethyl sulfoxide, etc. to prepare a coating solution, which is then applied on the surface of core particles for carrier, namely magnetic material particles. Although this application may be practiced by use of the dipping method, the spraying method, etc., it is particularly preferable to use the fluidized bed method. The fluidized method is a method in which core particles are elevated and floated to an equilibrated height by an ascending pressurized gas stream in a fluidized bed apparatus and the above coating solution is sprayed from above before the core particles fall down again to coat the respective particles, which procedure being repeated to form a coating with a desired thickness, whereby uniform coating can be formed on respective particles. The above coating solution may also contain other resins compatible with the resin for coating mixed and dissolved therein. In practicing the above operation, the core particles, namely the magnetic material particles, may have particle sizes of 30 to 200 μm, preferably 40 to 120 μm, particularly preferably 50 to 75 μm, and the thickness of the resin coated layer may preferably be 0.2 to 5 μm, particularly 0.5 to 2 μm. If the particle size is less than 30 μm, the free flowability of the carrier is low and the ability of conveying the toner to the developing region is small to result readily in lowering in image density. Besides, because coating treatment becomes difficult during preparation of the carrier, it is difficult to obtain a particle having uniform coated layer with the carrier of such small sizes. On the other hand, when the particle size exceeds 200 μm, the surface area of the carrier particles as a whole per unit weight is small and therefore the ability of conveying the toner to the developing region is small, whereby image density is liable to be lowered.

In the present invention, when such a coated carrier is used as the carrier, the carrier is excellent in humidity resistance and the triboelectric charging characteristic can be obtained stably for a long term. As the result, even when the carrier is provided for repeated uses, the charging characteristic and the charged quantity of the carrier are stable for a long term, with generation of weakly charged toner or toner charged to the opposite polarity being suppressed, whereby it becomes possible to perform good development stably.

When the carrier is made of the type in which magnetic material is dispersed, it can be prepared according to the same method as conventionally used in the prior art, for example, the method following the steps of kneading of the carrier starting materials, cooling, crushing and classification, or the method following various polycondensation steps. The carrier particles thus obtained may have sizes of, for example 10 to 50 μm, preferably 15 to 40 μm, particularly preferably 20 to 30 μm. The carrier particles may be indefinite in shape, or treated to be shaped in spheres for improvement of fluidity.

Figure 7:
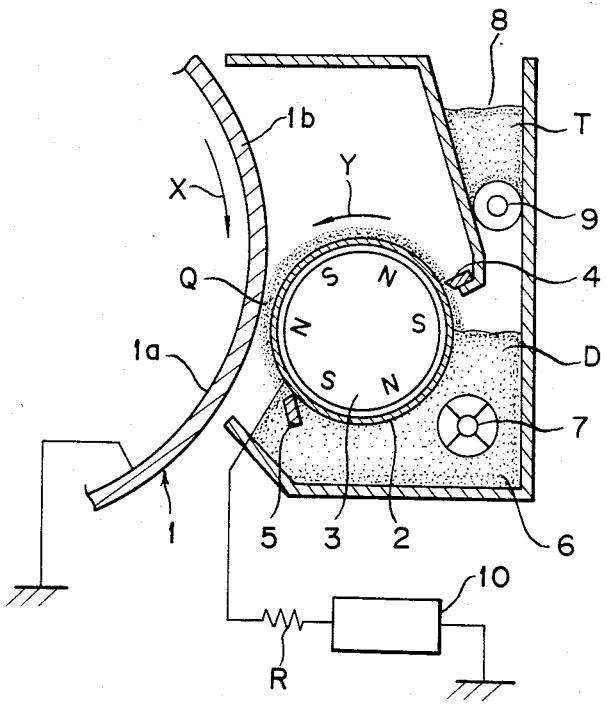
FIG. 7 is a sectional view for schematic illustration of an example of the developing device which can be used for performing the developing step in practice of this invention.

Referring now to an example of a specific device which can be used for practicing the developing steps in the present invention, an embodiment of the present invention is to be described. FIG. 7 shows an example of the device and, in FIG. 7, 1 is a latent image bearing member shaped in a rotatory drum comprising an OPC photosensitive member, which is constituted of, for example, a photosensitive layer 1*b* made of an organic photoconductive substance laminated on an aluminum cylindrical photoconductive substrate 1*a*. The latent image bearing member 1 is rotated in the direction of the arrowhead X, charged by a charger (not shown) at the surface to be developed to a constant potential, for example, within the range of from −400 to −700 V at the upstream side of the developing region Q and then the electrostatic latent image corresponding to the manuscript is formed by means of an exposure device (not shown), followed by movement of the electrostatic latent image to the developing region Q for development.

A developer carrying member is constituted of a sleeve 2 consisting of a non-magnetic material such as aluminum and a magnet 3 having a plurality of N, S poles provided internally in the sleeve 2 along the peripheral thereof, and the sleeve 2 is rotated so that it may move in the direction of the arrowhead Y, namely in the same direction as that of the latent image bearing member 1 in the developing region Q, while the magnet 3 is fixed. Also, the rotational number of the sleeve 2 is controlled depending on the linear velocity of the latent image bearing member 1, $V_P$, so that the linear velocity of of the sleeve 2, $V_S$, may satisfy the condition already described, namely $1.9 \leqq V_S/V_P \leqq 4$.

The N, S poles of the magnet 3 are magnetized to a magnetic density generally of 500 to 1500 Gauss, and the layer of the developer D comprising spikes erected in a brush, namely a magnetic brush, is formed on the surface of the sleeve 2 through its magnetic force. A doctor blade 4 consisting of a magnetic or non-magnetic material regulates the height and the amount of the magnetic brush, and a cleaning blade 5 removes the magnetic brush which has passed through the developing region Q from the sleeve 2. The surface of the sleeve 2 after cleaning contacts again the developer D in a developer reservoir 6 to form a new magnetic brush thereon, thereby feeding the developer D. A stirring screw 7 is used to stir the developer D in the developer reservoir 6 and make the components uniform. In the developer D in the developer reservoir 6, while the carrier is used repeatedly, the toner is consumed every time with development and therefore new toner particles T are supplemented suitably from a toner hopper 8. Toner particles T are falled into the developer reservoir 6 by the feeding rollers 9 having concave portions on the surface. The sleeve 2 is applied with a bias voltage through a protective resistance R from a bias power source 10.

In development of an electrostatic latent image, the edge of the magnetic brush should preferably contact shallowly the surface of the latent image bearing member 1 for effecting uniform development and, for this purpose, the distance (Hcut) between the edge of the doctor blade 4 and the surface of the sleeve 2 should preferably be made about 0.8-fold of the gap (Dsd) between the latent image bearing member 1 and the sleeve 2 in the developing region Q. The gap (Dsd) is preferably made 0.3 to 4.0 mm as already described.

In the device as described above, since the magnitude and the direction of the magnetic field on the surface of the sleeve 2 will change with rotation thereof, the carrier particles on the surface of the sleeve 2 are conveyed to the developing region Q while under rotational vibration following the rotational movement of the sleeve 2.

As described in detail above, according to the present invention, in an image forming method including the developing step of performing development by brushing a magnetic brush formed of a two-component developer against a latent image bearing member comprising an OPC photosensitive member, by controlling the greatness of the bias voltage, generation of fog can be surely prevented, and yet a clear image having high image density can be formed, with the result that the OPC photosensitive member can be stably used for a large number of times and excellent images can be obtained while obtaining sufficiently the benefits by use of an OPC photosensitive member such as high temperature durability, stable characteristics for a long term, etc.

Such effects can be brought about, as also be understood from the description of the Examples as shown below, for the following reasons. That is, because the ratio $V_S/V_p$ of the linear velocity of the developer carrying member $V_S$ to the linear velocity of the latent member $V_P$ is within the range of from 1.9 to 4, and also because the developer carrying member and the latent image bearing member move in the same direction in the developing region, the impact force which OPC photosensitive member receives from brushing of the magnetic brush can be considerably reduced so suppress triboelectric charging between the toner particles and the OPC photosensitive member simultaneously with conveying of a sufficient amount of toner into the developing region. Besides, when the carrier has a coated layer of a specific polymer on its surface and the specific polymer is formed of a monomeric composition comprising the monomers containing fluorine atoms with specific structure, namely the formula (I), (II) or (III) described above, as the main component the coated layer has preferably negatively chargeable characteristic as well as great mechanical and chemical durability. As a consequence, when provided for repeated uses, the charging characteristic and the charged amount of the carrier can be stable to suppress generation of weakly charged toner or toner charged to the opposite polarity, whereby images of high density without fog can be obtained even in formation of images for a large number of times.

Whereas, if the developer carrying member and the latent image bearing member move in opposite directions to each other in the developing region or if the above ratio $V_S/V_P$ exceeds 4, even though the moving directions may be the same, the impact force which the OPC photosensitive member receives from brushing with the magnetic brush is so great that the toner will be charged through friction with the OPC photosensitive member and the toner will be attached on the background portion other than the latent image portion to cause generation of fog; or if the above ratio $V_S/V_P$ is less than 1.9, the toner can be conveyed to the developing region only in an insufficient amount to cause lowering in image density.

The present invention is described by referring to the following specific examples, by which the present invention is not limited at all.

EXAMPLES 1 TO 6 AND COMPARATIVE EXAMPLES 1 TO 3

Carrier

Carriers A to F:

Each 15 g of the polymers (1) to (6) of which recurring units are represented by the following formulae was dissolved in 500 ml of a solvent mixture of acetone-methyl ethyl ketone (weight ratio: 1:1) (or 1,1,2trifluoro-1,2,2-trichloroethane) to prepare 6 kinds of coating solutions. By use of these coating solutions, 1 kg of a core material comprising spherical iron powder "DSP-135C" (produced by Dowa Teppun Kogyo Co.) was coated with each solution by means of a fluidized bed apparatus to obtain a carrier with a thickness of the coated layer of about 2 μm. These are called "Carrier A" to "Carrier F", respectively.

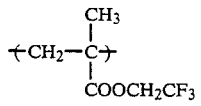
(1)

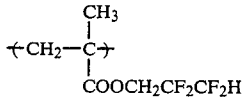
(2)

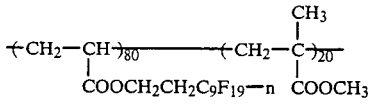
(3)

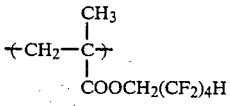
(4)

-continued

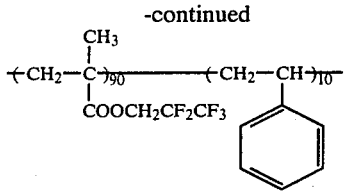

(5)

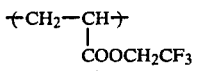

(6)

Toner

Toner A:

Terephthalic acid (332 g), 90 g of polyoxypropylene(2.2)-2,2-bis(4-hydroxyphenyl)propane and 587 g of bisphenol A were charged into a round bottomed flask equipped with a thermomemter, a stirrer made of stainless steel, a nitrogen gas introducing tube made of glass and a flow-down type condenser. The flask was set in a mantle heater, and the temperature was elevated while maintaining the flask internally under an inert atmosphere by introducing nitrogen gas through the nitrogen gas introducing inlet. And, 0.05 g of dibutyl tin oxide was added and the reaction was carried out at 200° C. while monitoring the reaction at the softening point to obtain a polyester resin.

This polyester resin (100 parts by weight), 10 parts by weight of carbon black "Regal 660R" (produced by Cabot Co.), 2 parts by weight of a low molecular weight polypropylene "Piscol 660P" (produced by Sanyo Kasei Kogyo Co.) and 2 parts by weight of ethylene-bisstearoylamide "Hoechst Wax C" (produced by Hoechst Co.) were mixed in a ball mill and, following the respective steps of kneading, pulverization and classification, a toner with a mean particle size of 10 μm was obtained. This is called "Toner A".

Toner B:

A styrene-methyl methacrylate-n-butyl methacrylate copolymer (100 parts by weight) obtained by the reaction of styrene, methyl methacrylate and n-butyl methacrylate at a molar ratio of 50:20:30, 10 parts by weight of carbon black "Regal 660R" (produced by Cabot Co.), 3 parts by weight of a low molecular weight polypropylene "Piscol 660P" (produced by Sanyo Kasei Kogyo Co.) were mixed in a ball mill and, following the respective steps of kneading, pulverization and classification, a toner with a mean particle size of 11 μm was obtained. This is called "Toner B".

Toner C:

A styrene-methyl methacrylate-n-butyl methacrylate copolymer (100 parts by weight) obtained by the reaction of styrene, methyl methacrylate and n-butyl methacrylate at a molar ratio of 50:20:30, 10 parts by weight of carbon black "Regal 660R" (produced by Cabot Co.), 3 parts by weight of a low molecular weight polypropylene "Piscol 660P" (produced by Sanyo Kasei Kogyo Co.) and 2 parts by weight of a Nigrosine dye "Oil Black SO" (produced by Orient Kagaku Co.) were mixed in a ball mill and, following the respective steps of kneading, pulverization and classification, a toner with a mean particle size of 11 μm was obtained. This is called "Toner C".

Developer

The above Toner A to Toner C and the above Carrier A to Carrier F were mixed according to the combinations as shown in Table 1 to prepare 9 kinds of two-component developers containing 2% by weight of toner.

Photosensitive member

A photosensitive layer with a negatively chargeable two-layer structure formed by use of an anthanthrone type pigment as the carrier generation substance and a carbazole derivative as the carrier transport substance was laminated on a drum-shaped aluminum photoconductive substrate. This is called "OPC photosensitive member A".

The above OPC photosensitive member A was mounted as the latent image bearing member on a modified electrophotographic copying machine "U-Bix 3000" (produced by Konishiroku Photo Industry Co.) and continuous real copying tests were conducted for 10000 times following the conditions shown below in Table 1 in respective Examples and Comparative Examples for examination of generation of fog and the maximum image density (Dmax) in the final images. The results are also shown in Table 1.

As for other conditions, the surface potential (maximum potential) when charging is effected in the OPC photosensitive member A is −550 V, the gap (Dsd) between the OPC photosensitive member A and the sleeve is 0.9 mm, the distance (Hcut) between the edge of the doctor blade and the sleeve is 0.6 mm, the magnet is a fixed type, the magnetic flux density on the sleeve surface is 800 Gauss, the bias voltage applied on the sleeve is −100 V of direct current voltage.

As to generation of fog, the area percentage of the black ground in the copied image corresponding to the white ground in the original image is evaluated by the value measured by means of a dot analysis device "Sakura Areaduck-100" (produced by Konishiroku Photo Industry Co.), and the maximum density (Dmax) is evaluated in terms of the relative density to the image density of the original image as 1.3.

TABLE 1

| | Developer | | Linear velocity of sleeve; Vs | Linear velocity of OPC photosensitive member A; Vp | Direction of movement of sleeve and photosensitive member in | | | |
|---|---|---|---|---|---|---|---|---|
| | Toner | Carrier | (mm/sec) | (mm/sec) | developing region | Vs/Vp | Fog (%) | Dmax |
| Example 1 | Toner A | Carrier A | 300 | 100 | the same | 3 | ≦0.1 | ≧1.3 |
| Example 2 | Toner A | Carrier B | 400 | 150 | the same | 2.7 | ≦0.1 | ≧1.3 |
| Example 3 | Toner A | Carrier C | 400 | 150 | the same | 2.7 | ≦0.1 | ≧1.3 |
| Example 4 | Toner B | Carrier D | 500 | 200 | the same | 2.5 | ≦0.1 | ≧1.3 |
| Example 5 | Toner B | Carrier E | 600 | 200 | the same | 3 | ≦0.1 | ≧1.3 |
| Example 6 | Toner A | Carrier F | 350 | 100 | the same | 3.5 | ≦0.1 | ≧1.3 |
| Comparative Example 1 | Toner B | Carrier D | 360 | 200 | the same | 1.8 | ≦0.1 | 0.8 |
| Comparative | Toner B | Carrier D | 900 | 200 | the same | 4.5 | 0.9 | ≧1.3 |

TABLE 1-continued

| | Developer | | Linear velocity of sleeve; Vs | Linear velocity of OPC photosensitive member A; Vp | Direction of movement of sleeve and photosensitive member in | | | |
|---|---|---|---|---|---|---|---|---|
| | Toner | Carrier | (mm/sec) | (mm/sec) | developing region | Vs/Vp | Fog (%) | Dmax |
| Example 2 | | | | | | | | |
| Comparative Example 3 | Toner B | Carrier D | 500 | 200 | opposite | 2.5 | 1.5 | ≧1.3 |

As can be understood from the results in Table 1, according to any of Examples 1 to 6 of the present invention, images of high image density without fog as initial images could be obtained even after continuous copying of 10000 time.

In contrast, according to Comparative Example 1, the image density was lower because the value of $V_S/V_P$ was less than 1.9; according to Comparative Examples 2, fog was generated abundantly because the value of $V_S/V_P$ exceeded 4; and according to Comparative Examples 3, fog was generated markedly abundantly because the sleeve and the photosensitive member moved in opposite directions in the developing region.

EXAMPLES 7 TO 12 AND COMPARATIVE EXAMPLES 4 to 6

Carrier

Carrier G:

A coating solution was prepared by dissolving 15 g of a vinylidene fluoride-tetrafluoroethylene copolymer "VT-100"(produced by Daikin Kogyo Co.) in 500 ml of a solvent mixture of acetone-methyl ethyl ketone (weight ratio: 1:1) and 1 Kg of a core material comprising 0 spherical iron powder "DSP-135 C" (produced by Dowa Teppun Kogyo Co.) was coated with this coating solution by use of fluidized bed apparatus to obtain a carrier with a coated layer thickness of about 2 μm. This is called "Carrier G".

Carrier H:

A carrier was prepared in the same manner as in preparation of Carrier G except for preparing a coating solution from 9 g of a vinylidene fluoride-tetrafluoroethylene copolymer "VT-100" (produced by Daikin Kogyo Co.) and 6 g of a methyl methacrylate copolymer "Acrypet MF" (produced by Mitsubishi Rayon Co.). This is called "Carrier H".

Carrier J:

With the use of a suspension of a polytetrafluoroethylene "852-201 Clear Teflon Enamel" (produced by Du Pont Co.), coating treatment was carried out in the same manner as in preparation of Carrier G, followed further by heat treatment in a furnace at about 350° C. for one hour, subsequently cooling to room temperature and classification, to obtain a carrier. This is called "Carrier J".

Toner

Toner A:

The same toner as used in Examples 1 to 6 and Comparative Examples 1 to 3 was employed.

Toner B:

The same toner as used in Examples 1 to 6 and Comparative examples 1 to 3 was employed.

Developer

The above Toner A, B, and the above Carrier G, H and J were mixed according to the combinations as indicated in Table 2 to obtain 9 kinds of two-component developers containing 2 wt. % of toner.

Photosensitive member

The same photosensitive member as used in Examples 1 to 6 and Comparative Examples 1 to 3 was employed.

The above OPC photosensitive member A was mounted as the latent image bearing member on an electrophotographic copying machine "U-Bix 3000" (produced by Konishiroku Photo Industry Co.) and continuous real copying tests were conducted for 10000 times following the conditions shown below in Table 2 in respective Examples and Comparative Examples for examination of generation of fog and the maximum image density (Dmax) in the final images. The results are also shown in Table 2. As to other experimental conditions and the method for evaluation of generation of fog, those as described in Examples 1 to 6 and Comparative Examples 1 to 3 were employed.

TABLE 2

| | Developer | | Linear velocity of sleeve; Vs | Linear velocity of OPC photosensitive member A; Vp | Direction of movement of sleeve and photosensitive member in | | | |
|---|---|---|---|---|---|---|---|---|
| | Toner | Carrier | (mm/sec) | (mm/sec) | developing region | Vs/Vp | Fog (%) | Dmax |
| Example 7 | Toner A | Carrier G | 400 | 150 | the same | 2.7 | ≦0.1 | ≧1.3 |
| Example 8 | Toner A | Carrier G | 300 | 100 | the same | 3.0 | ≦0.1 | ≧1.3 |
| Example 9 | Toner A | Carrier H | 400 | 150 | the same | 2.7 | ≦0.1 | ≧1.3 |
| Example 10 | Toner A | Carrier H | 350 | 100 | the same | 3.5 | ≦0.1 | ≧1.3 |
| Example 11 | Toner A | Carrier J | 400 | 150 | the same | 2.7 | ≦0.1 | ≧1.3 |
| Example 12 | Toner A | Carrier J | 500 | 200 | the same | 2.5 | ≦0.1 | ≧1.3 |
| Comparative Example 4 | Toner A | Carrier G | 360 | 200 | the same | 1.8 | ≦0.1 | 0.7 |
| Comparative Example 5 | Toner A | Carrier G | 900 | 200 | the same | 4.5 | 0.9 | ≧1.3 |
| Comparative Example 6 | Toner A | Carrier G | 600 | 200 | opposite | 3 | 1.4 | ≧1.3 |

As can be understood from the results in Table 2, according to any of Examples 7 to 12 of the present invention, images of high image density without fog as the initial images could be obtained even after continuous copying of 10000 times.

In contrast, according to Comparative Example 4, the image density was lower because the value of $V_S/V_P$ was less than 1.9; according to Comparative Examples 5, fog was generated abundantly because the value of $V_S/V_P$ exceeded 4; and according to Comparative Examples 6, fog was generated markedly abundantly because the sleeve and the photosensitive member moved in opposite directions in the developing region.

We claim:

1. A process for forming an image comprising:

forming a latent image on a movable latent image bearing member, said movable latent image bearing member comprising an organic photoconductive photosensitive member;

forming a magnetic brush comprised of a two-component developer, which includes a toner and a carrier, on a movable developer carrying member, said movable developer carrying member having at least a portion thereof opposed to said latent image bearing member in a developing region;

moving said latent image bearing member and said developer carrying member in a developing region; and developing said latent image on said latent image bearing member by brushing it with said brush in said developing region;

said developer carrying member comprising a single movable sleeve;

said latent image bearing member and said single sleeve of said developer carrying member moved in the same direction in said developing region at respective linear velocities; and the ratio $V_S/V_P$ of the linear velocity of said single sleeve of said developer carrying menber $V_S$ to the linear velocity of said latent image bearing member $V_P$ being within the range of $1.9 \leqq V_S/V_P \leqq 4$.

2. The process according to claim 1, wherein said carrier comprises a core material and a polymer comprising a monomer component represented by the following Formula (I), (II) or (III):

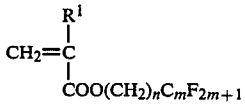
Formula (I)

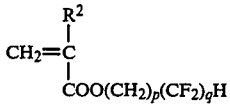
Formula (II)

wherein $R^1$ and $R^2$ each represent a hydrogen atom or a methyl group, n and p each represent an integer of 1 to 8, m and q each represent an integer of 1 to 19,

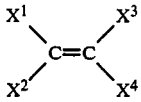
Formula (III)

wherein $X^1$, $X^2$, $X^3$ and $X^4$ each represent a hydrogen atom, a chlorine atom, a fluorine atom, a lower perfluoroalkyl group or a lower perfluoroalkoxy group, which may be either identical or different, and at least 2 of $X^1$, $X^2$, $X^3$ and $X^4$ are fluorine atoms.

3. The process according to claim 2, wherein said carrier comprises a core comprised of a core material and a polymer layer provided on the surface thereof.

4. The process according to claim 3, wherein said core has a particle size within the range of 30 to 200 μm and said polymer layer has a thickness within the range of 0.2 to 5 μm.

5. The process according to claim 2, wherein the core material in said carrier is a metal or an alloy having ferromagnetic property, or an alloy exhibiting ferromagnetic property by heat treatment.

6. The process according to claim 2, wherein said polymer in said carrier contains said monomer component in an amount of 50 % by weight or more.

7. The process according to claim 1, wherein said single sleeve of said developer carrying member has a magnet therein.

8. The process according to claim 7, wherein a doctor blade for regulating the height and the amount of said magnetic brush is provided upstream of the developing region.

9. The process according to claim 2, wherein said monomer constituting the polymer is selected from the group consisting of monomers represented by the following formulae (I') and (II'):

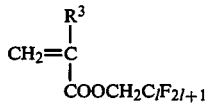
Formula (I')

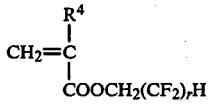
Formula (II')

wherein $R^3$ and $R^4$ each represent a hydrogen atom or a methyl group, l represents an integer of 1 or 2 and r represents an integer of 2 to 4.

10. The process according to claim 2, wherein said polymer in the carrier is selected from the group consisting of polymers represented by the following formulae:

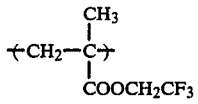
(1)

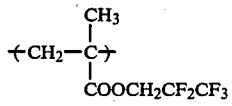
(2)

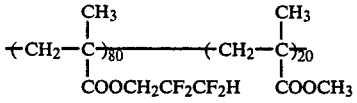
(3)

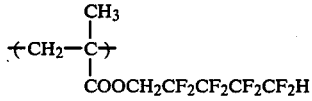
(4)

-continued

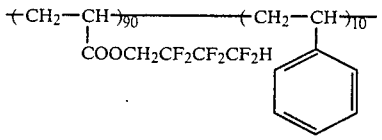

(5)

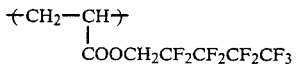

(6)

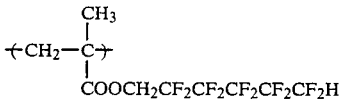

(7)

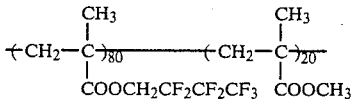

(8)

(9)

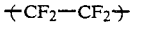

(10)

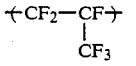

(11)

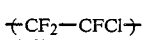

(12)

(13)

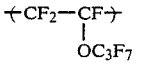

11. The process according to claim 1, wherein said toner has a particle size within the range of 8 to 12 μm.

12. The process according to claim 4, wherein the core material in the said carrier is a metal or an alloy having ferromagnetic property, or an alloy exhibiting ferromagnetic property by heat treatment.

13. The process according to claim 12, wherein said polymer in said carrier contains said monomer component in an amount of 50% by weight or more.

14. The process according to claim 4, wherein said polymer in said carrier contains said monomer component in an amount of 50% by weight or more.

15. The process according to claim 4, wherein said monomer consituting the polymer is selected from the group consisting of monomers represented by the following formulaw (I') and (II'):

Formula (I')

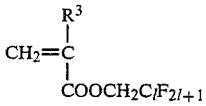

Formula (II')

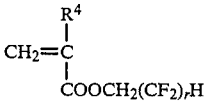

wherein $R^3$ and $R^4$ each represent a hydrogen atom or a methyl group, l represents an integer of 1 or 2 and r represents an integer of 2 to 4.

16. The process according to claim 4, wherein said polymer in the carrier is selected from the group consisting of polymers represented by the following formulae:

(1)

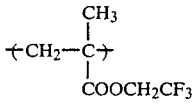

(2)

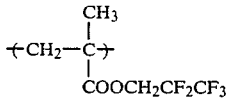

(3)

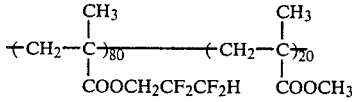

(4)

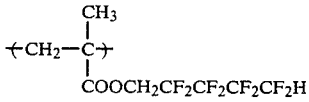

(5)

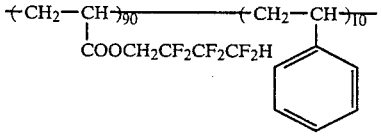

(6)

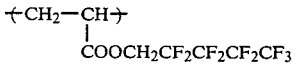

(7)

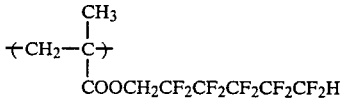

(8)

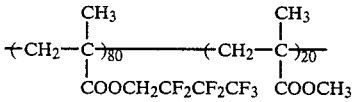

(9)

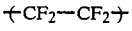

(10)

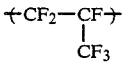

(11)

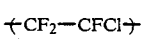

(12)

(13)

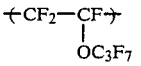

17. The process according to claim 16, wherein the core material in said carrier is a metal or an alloy having ferromagnetic property, or an alloy exhibiting ferromagnetic property by heat treatment.

18. The process according to claim 17, wherein said polymer in said carrier contains said monomer component in an amount of 50% by weight or more.

19. The process according to claim 4, wherein said toner has a particle size within the range of 8 to 12 μm.

20. The process according to claim 10, wherein said toner has a particle size within the range of 8 to 12 μm.

* * * * *